United States Patent [19]

Miyake

[11] Patent Number: 5,066,988

[45] Date of Patent: Nov. 19, 1991

[54] ELECTROPHOTOGRAPHIC APPARATUS HAVING MEANS FOR AVOIDING BLURRING EFFECTS CAUSED BY IDLE INTERVALS

[75] Inventor: Nobuyuki Miyake, Yokohama, Japan

[73] Assignee: Canon Kabushiki Kaisha, Tokyo, Japan

[21] Appl. No.: 405,238

[22] Filed: Sep. 11, 1989

[30] Foreign Application Priority Data

Sep. 30, 1988 [JP] Japan ..... 63-246311

[51] Int. Cl.[5] ..... G03G 15/06

[52] U.S. Cl. ..... 355/245; 118/652

[58] Field of Search ..... 355/245, 268, 326, 296, 355/260, 270, 211, 210, 208, 215, 269, 246; 118/652, 653, 657

[56] References Cited

U.S. PATENT DOCUMENTS

| | | | |
|---|---|---|---|
| 4,142,165 | 2/1979 | Miyakawa et al. | 355/270 |
| 4,339,196 | 7/1982 | Beck et al. | 355/245 X |
| 4,607,936 | 8/1986 | Miyakawa et al. | 355/211 X |
| 4,714,942 | 12/1987 | Nakanishi | 355/268 |
| 4,720,727 | 1/1988 | Yoshida | 355/210 X |
| 4,754,301 | 6/1988 | Kasamura et al. | 355/245 |
| 4,769,676 | 9/1988 | Mukai et al. | 118/652 X |
| 4,801,966 | 1/1989 | Ikeda | 355/245 |
| 4,814,816 | 3/1989 | Idenawa | 118/657 X |
| 4,862,219 | 8/1989 | Yoshida et al. | 355/202 |
| 4,870,447 | 9/1989 | Yoshida et al. | 355/204 |

FOREIGN PATENT DOCUMENTS

| | | | |
|---|---|---|---|
| 0048060 | 3/1985 | Japan | 355/269 |
| 0280877 | 12/1987 | Japan | 355/245 |
| 0288870 | 12/1987 | Japan | 355/245 |
| 0100475 | 5/1988 | Japan | 355/326 |
| 0100476 | 5/1988 | Japan | 355/326 |
| 0109468 | 5/1988 | Japan | 355/245 |

*Primary Examiner*—A. T. Grimley
*Assistant Examiner*—William J. Royer
*Attorney, Agent, or Firm*—Fitzpatrick, Cella, Harper & Scinto

[57] ABSTRACT

An electrophotographic apapratus which avoids blurred and tainted images caused by toner being heated during idle periods by a heated photosensitive drum. In one aspect a developing roller is separated from the drum during the idle periods. In another aspect toner is forcibly removed from the developing roller by application of a reverse bias voltage during the interval between turning on a main switch and the time at which copying becomes possible.

7 Claims, 6 Drawing Sheets

ELECTROPHOTOGRAPHIC APPARATUS HAVING MEANS FOR AVOIDING BLURRING EFFECTS CAUSED BY IDLE INTERVALS

BACKGROUND OF THE INVENTION

1. Field of the Invention

This invention relates to electrophotographic apparatus and more particularly to improvements in such apparatus which avoid the blurring effects caused when such apparatus with heated photosensitive elements are taken out of use for substantial periods of time.

2. Description of the Prior Art

As shown in FIG. 2, a known electrophotographic apparatus has a latent image forming device, a developing device, a cleaning device, etc., as major structural elements arranged around a photosensitive drum 1. The outer surface of the photosensitive drum 1 rotates in the direction of an arrow A and is electrostatically charged in a uniform manner by a charger 2. A light image from an original to be copied is formed on charged surface of the photosensitive drum 1 through an exposure slit 3 and a not shown lighting and optical system. This produces an electrostatic latent image on the surface of the photosensitive drum 1. A toner image is then formed on the electrostatic image by a developing device 4*a* or 4*b*. Subsequently a recording material, such as a paper sheet, is sent by a paper supply device (not shown) and a pair of register rollers 5 to the surface of the photosensitive drum 1. The toner image is then transferred onto the recording material from the surface of the photosensitive drum by transfer and separation devices 6. The recording material is then sent to a fixing device (not shown) by a transport system 7. There the toner is fixed on the recording material. In the meantime, the remaining toner left on the surface of the photosensitive drum 1 after transfer is removed from the drum by a cleaning device 8. Also, the remaining electrostatic charge is erased from the drum by an eraser lamp 9 so that the drum can be used repeatedly.

The photosensitive drum may be the OPC (organic photoconductor) type, which is widely used, or it may be the "asi" (amorphous-silicon) type which is also used and which has excellent durability.

Within the photosensitive drum 1 there is provided a heater (not shown) which warms the drum surface to a certain temperature for the purpose of increasing photosensitivity or preventing blurring of images which would otherwise be caused by moisture absorption on the photosensitive drum surface. Especially for the purpose of preventing blurring of images it is necessary to apply an electric current to the heater independently to keep the drum surface warmed to a temperature of about 40–44 degrees centigrade, not only during normal operation but also when the apparatus is shut off. That is, when the power switch (main switch) for the electric power supply which drives the means for copying operation such as the charger 2, the lighting and optical system, the developing devices 4*a* and 4*b*, the rollers 5, the charger 6, and the lamp 9, is turned off and the whole apparatus is left suspended, for example overnight, the heater which warms the drum surface is left on.

However when the photosensitive drum is kept warm during night or other extended idle periods for the purpose of preventing blurring of images as aforementioned, a problem arises in that the density of images produced by the apparatus is low at the time of switching on the apparatus (at the time of turning on the power switch), for example first thing in the morning. The precise cause of this is unknown; however it is presumed that owing to the suspension of machine operation for a long time, such as suspension during night hours, the toner on the developing roller is influenced by the heat of the drum heater and deteriorates. Therefore the state of the triboelectricity of the toner on the developing roller becomes unstable when the toner is re-used. Thus, it is believed that such tainted image is caused by the toner's deterioration.

SUMMARY OF THE INVENTION

An object of the present invention is to provide means for restraining or preventing the above described toner deterioration on the developing roller which results from the heat used to maintain the temperature of the photosensitive drum when the apparatus is not being used. To achieve the above object the electrophotographic apparatus, according to one aspect of the present invention, is provided with means to separate the developing roller from the photosensitive drum when the operation of the apparatus is to be suspended for a significant length of time. According to another aspect of the invention, additional developing bias is imposed at the time of turning on the main switch for forcibly removing the toner on the developing roller.

Thus the deterioration of the toner on the developing roller and tainting of images by the influence of the heater are prevented and the decrease of image density is avoided when the apparatus is put back into operation, for example at the starting time in the morning.

BRIEF DESCRIPTION OF THE DRAWINGS

The structure, functions, and advantages of the present invention will become apparent from the following detailed description of the preferred embodiment and the appended drawings in which.

DETAILED DESCRIPTION OF THE PREFERRED EMBODIMENTS

Figure 1:
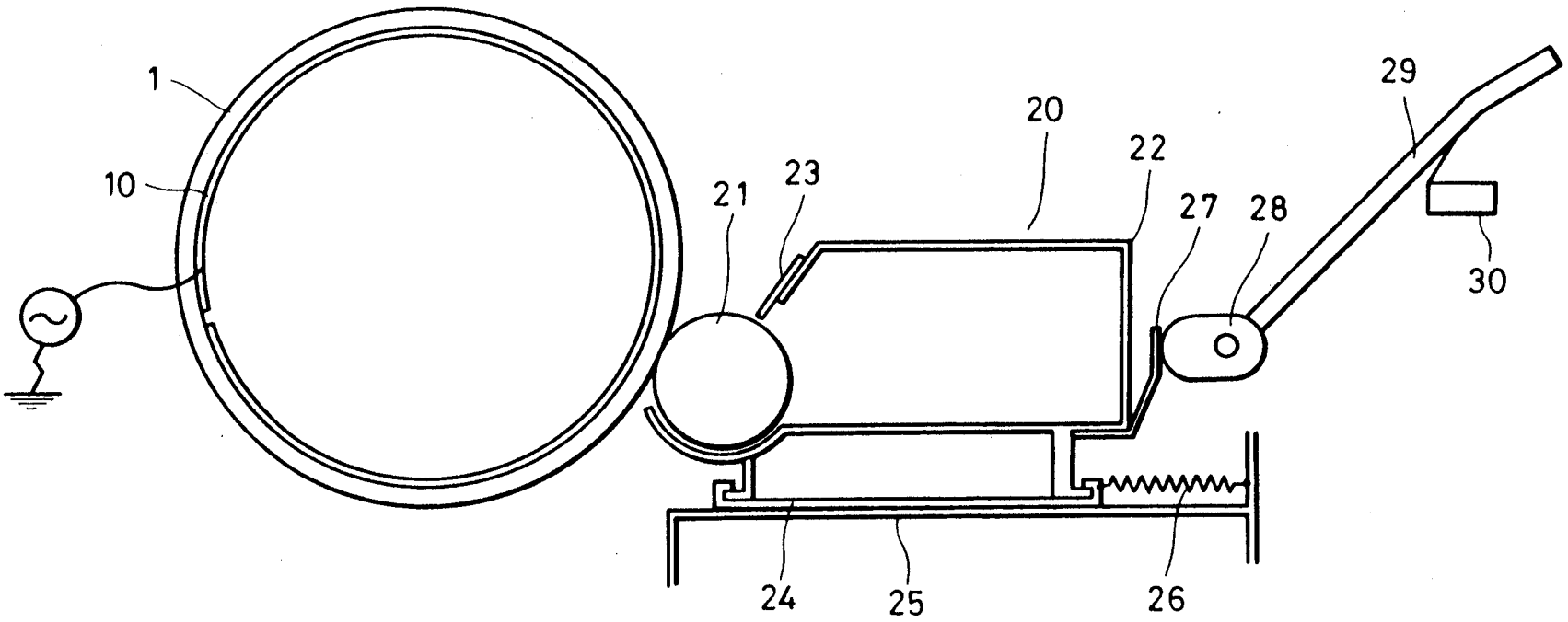
FIG. 1 is a side elevational view in schematic of the circumference of a photosensitive drum and developing device in an electro-photographic apparatus in which the present invention is embodied.
Figure 2:
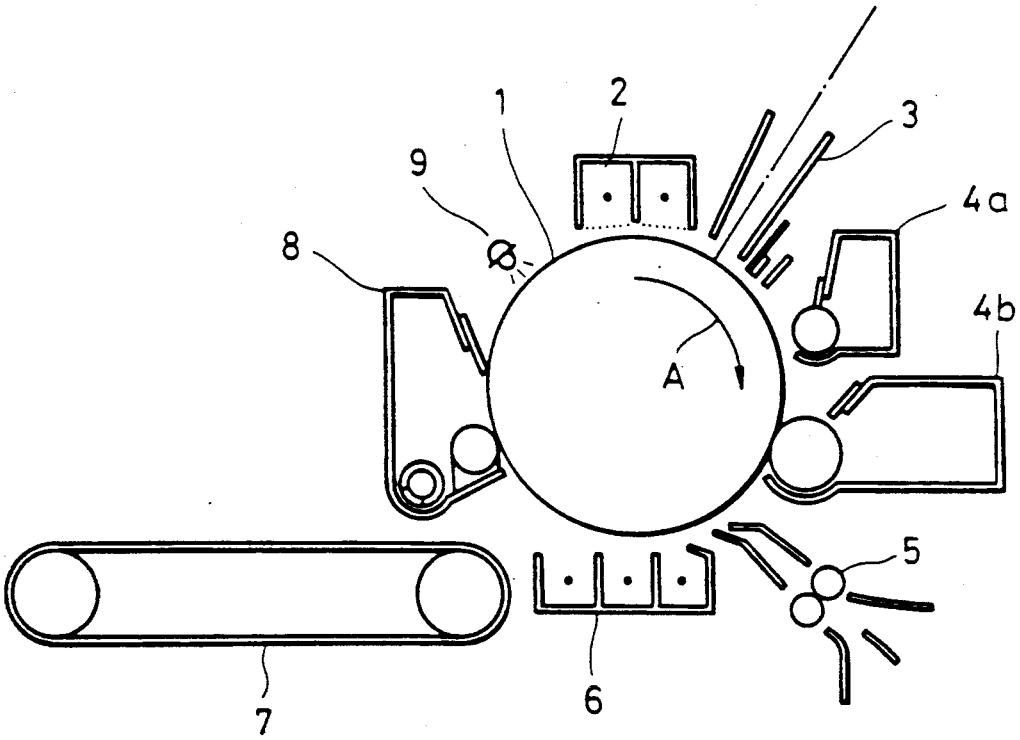
FIG. 2 PRIOR ART
FIG. 2 is a side elevational view in schematic of the principal components of a publicly known electrophotographic apparatus.

The various elements of FIG. 1 are arranged in apparatus as shown in FIG. 2.

As shown in FIG. 1, a photosensitive drum 1 contains a plane heater 10 within the drum cylinder. A developing device 20 is located next to the drum 1 and comprises a magnetic blade 23 which coats the surface of a developing roller 21 with a uniform thickness of toner from a developer container 22. The developing roller 21 has magnets therein for handling the toner as is well known. The developer container 22 is inserted into and housed on a developing rail carriage 24. The developing rail carriage 24 slides on a supporting table 25 and is pulled by a pressure releasing spring 26 in a direction of separating the developing roller 21 from a fixed position at the surface of the photosensitive drum 1 where developing takes place. On the other hand, a pressure spring element 27 is attached to the developer container 22 and an eccentric cam 28 is mechanically connected via a lever 29 with a main switch 30. Therefore by swinging the lever 29 clockwise as viewed in FIG. 1 in synchronism with movement of the main switch 30 the cam 28 turns and presses on the spring element 27 so that the developing roller 21 is kept at the fixed state adjacent to the photosensitive drum 1, thus making developing possible. On the other hand, when the main switch 30 is to be turned off for a long period of time, the lever 29 is moved in the opposite direction. As a result, the eccentric cam 28 is rotated away from the spring element 27 and releases the developing roller 21 so that it becomes separated from the photosensitive drum 1 by force of the spring 26. In case the main switch is turned off to discontinue the use of the apparatus for a significant length of time, for example during night, the developing roller 21 is separated about 10 mm from the photosensitive drum 1. The normal working gap is about 250μm. Accordingly, by providing for separation of the developing roller from the photosensitive drum according to the present invention, the heat influence of the drum heater on the toner coated on the developing roller 21 is greatly reduced.

Figure 3:
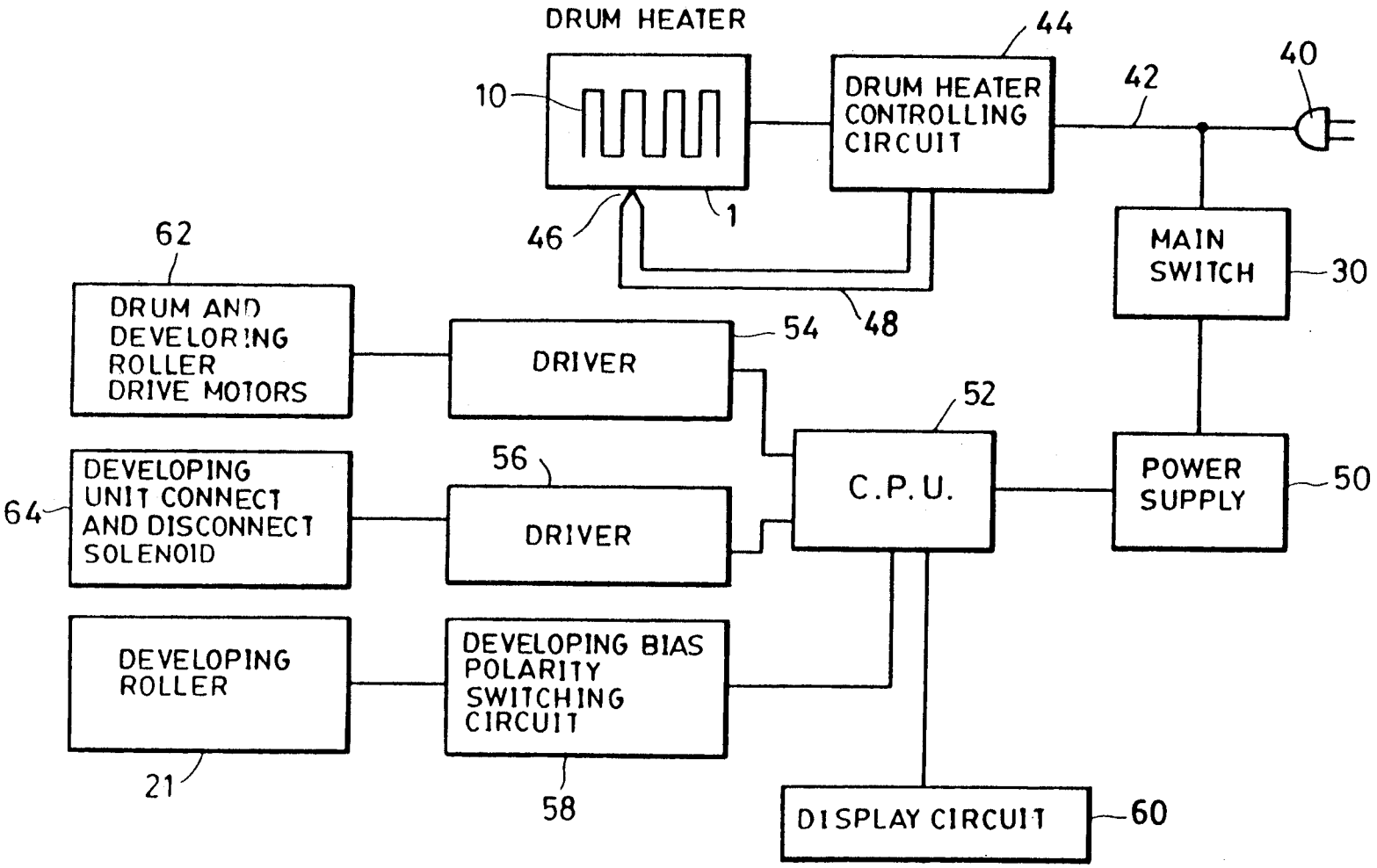
FIG. 3 is a block diagram showing the various elements of the apparatus of FIG. 1 and their interconnection.

As shown in FIG. 3 outside electrical power is supplied via an electrical plug 40 and a main power line 42 directly to a drum heating control circuit 44 which in turn supplies controlled electrical current to the drum heater 10. A temperature sensor 46 is arranged near the surface of the drum 1 and produces an output signal corresponding to the drum temperature. This output signal is fed back via a sensor line 48 to the control circuit 44 and is used to adjust the electrical current to the drum heater so as to maintain a desired controlled temperature at the drum surface.

The main switch 30 is connected between the main power line 42 and the other components of the copying apparatus. As shown, the switch 30 is connected to a power supply circuit 50 which produces the appropriate electrical current, etc. for proper operation of the various components. The output of the power supply circuit 50 is supplied to a CPU (central processing unit) 52 which is programmed to control the sequence or timing of the operation of the various system components. The CPU 52 in turn supplies signals over appropriate lines to drivers 54 and 56 as well as a developing bias polarity switching circuit 58 and a display circuit 60. The driver 54 is connected to supply driving power, as directed by the CPU 52, to motors (shown in FIG. 3 at 62) which turn the photosensitive drum 1 and the developing roller 21 (FIG. 1). The driver 56 is connected to supply driving power, as directed by the CPU 52, to a solenoid (shown in FIG. 3 at 64) which moves the lever 29 (FIG. 1) for bringing the developing unit into and out of operating engagement with the developing roller 21. The developing bias polarity switching circuit 58 is connected and arranged to produce a desired bias voltage on the developing roller 21. Thus, during normal copying, the bias voltage is such as to attract developer toner from the container 22 (FIG. 1) onto the developing roller. During the interval immediately preceding normal copying, the bias voltage is reversed so that developer toner which may be present on the surface of the developing roller is forcibly removed.

Each of the components shown in block form in FIG. 3, namely the drum heating control circuit 44, the temperature sensor 46, the power supply circuit 50, the CPU 52, the drivers 54 and 56, the developing bias polarity switching circuit 58 and the display circuit 60 are individually well known and their particular construction is not part of the invention or its best mode.

Figure 4:
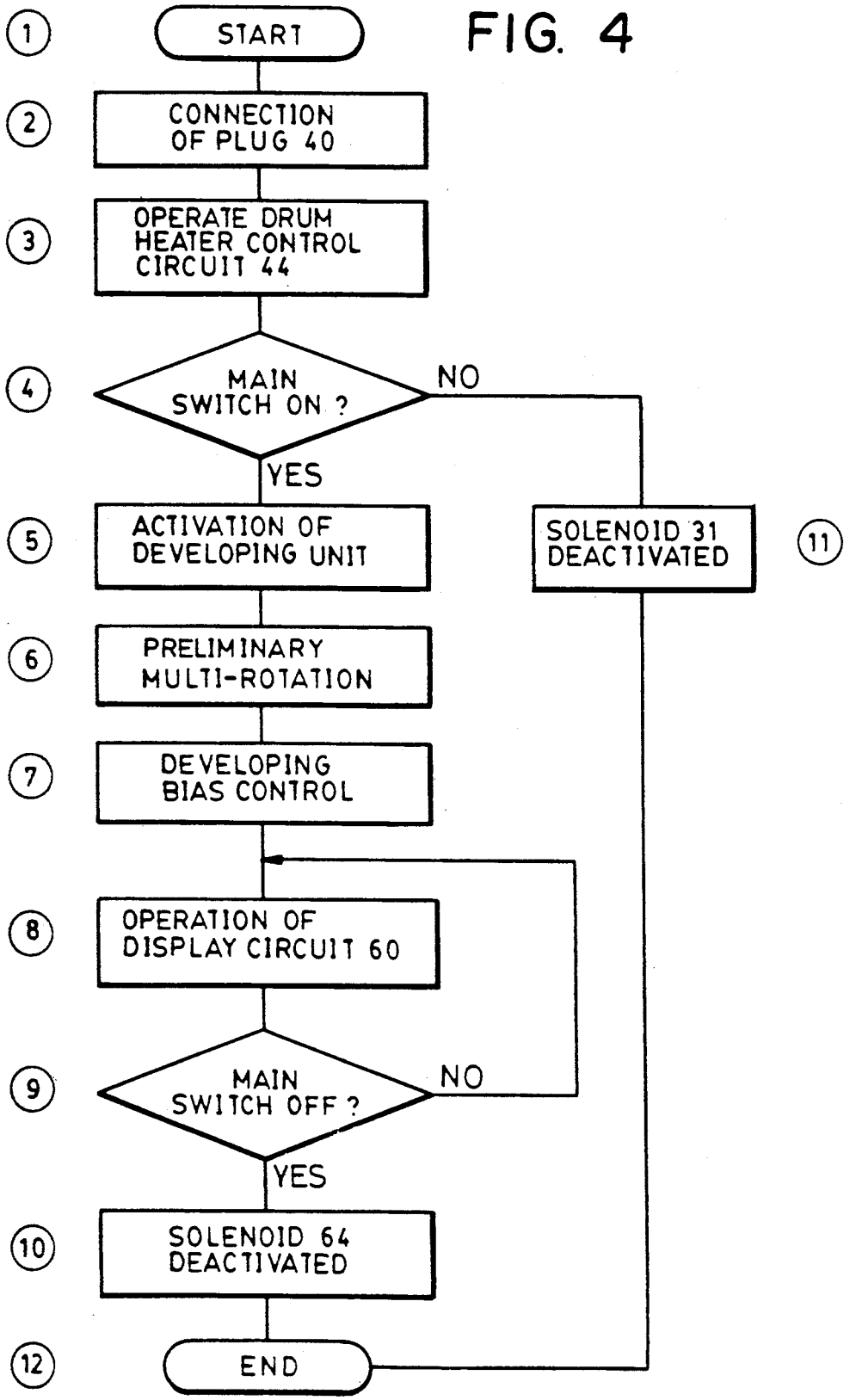
FIG. 4 is a flow diagram for explaining the operation of the apparatus of FIG. 1.

The operation of the apparatus of FIG. 1–3 is shown in the flow chart of FIG. 4.

When the plug 40 is connected to an outside electrical power source, the drum heater control circuit 44 operates the drum heater 10 irrespective of the on or off condition of the main switch 30. This is because the main power line 42 from the plug 40 to the drum heater control circuit 44 bypasses the main switch 30. The drum heater control circuit operates the drum heater 10 in a manner such that the drum 1 retains a pre-determined temperature. That is, the temperature of the drum is detected by the sensor 46 and when the temperature of the drum is lower than a pre-determined temperature, an electric current is applied to the heater. When the drum temperature is higher than a pre-determined temperature, the electric current to the heater is stopped.

Now when the main switch 30 is turned on, electric current is applied to the power supply circuit 50 which in turn supplies electrical power to the CPU 52, the drivers 54 and 56 and the drum and developing roller motors 62 (FIG. 3) as well as the developing bias polarity switching circuit 58 and the display circuit 60. The CPU 52 controls the sequence of operation according to the Steps 4-11 in the flow chart of FIG. 4.

As shown in FIG. 4, in Step 5, the developing unit 20 is activated, the solenoid 31 is operated, the developing unit is moved to the drum 1 and the developing roller 21 is positioned adjacent the drum surface where the developing operation is possible. In Step 6, i.e. preliminary multi-rotation, the drum and developing roller motors 62 are operated to rotate the drum and roller a number of times.

In Step 7 developing bias control takes place by operation of the developing bias polarity switching circuit 58 to impose a bias voltage on the developing roller 21 with a polarity which is opposite to that imposed at the time of developing electrostatic latent images on the drum 1. That is, in Step 7 the polarity of the voltage applied to the developing roller 21 by the switching circuit 58 is the same as that of the toner.

In Step 8 the display circuit 60 is operated to indicate to the operator that the copying is now possible with the apparatus.

In Steps 10 and 11, the solenoid 64 is deactivated or turned off.

Figure 5:
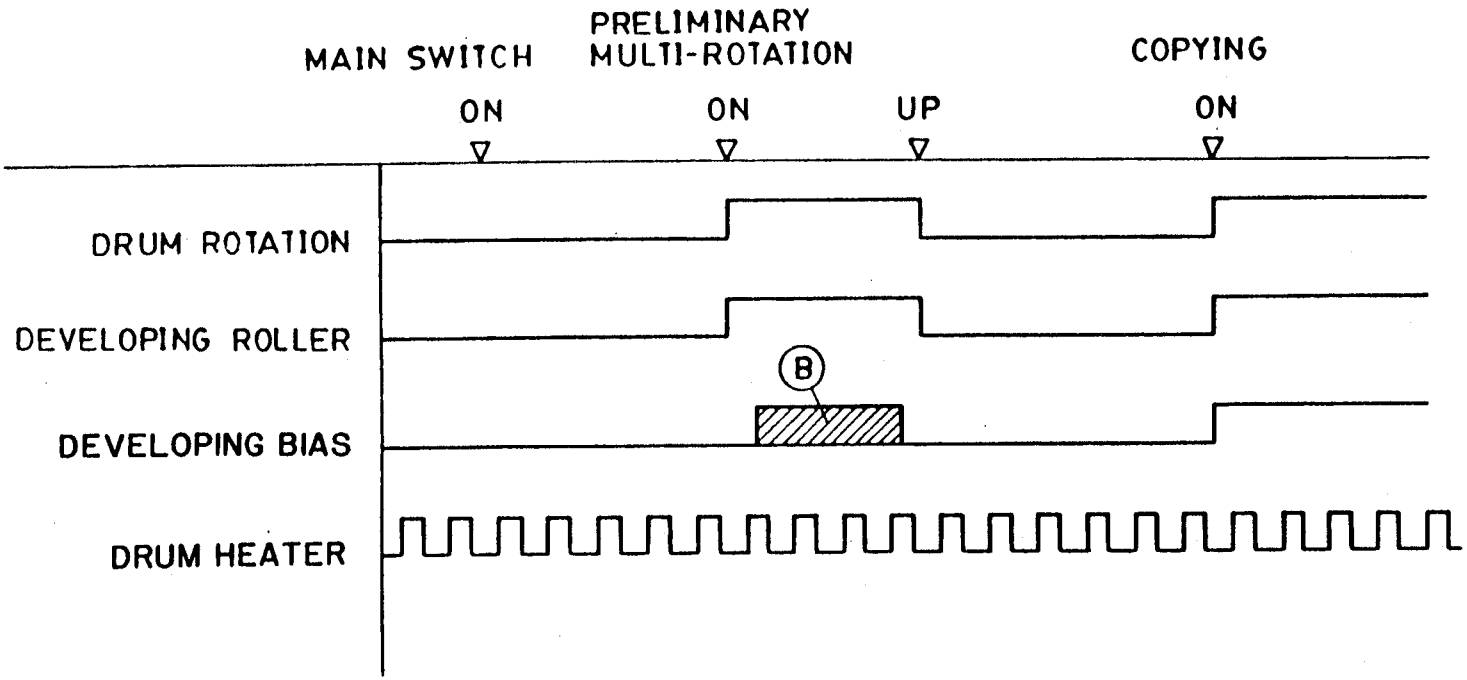
FIG. 5 is a timing diagram used to explain the operation of one aspect of the invention.

FIG. 5 is a timing diagram showing one manner of operation according to the present invention. According to the diagram, from a certain moment after the main switch 30 is turned on, or from a moment when a fixing device reaches a certain controlled temperature ("warming up"), the drum 1 is rotated (this is called preliminary multi-rotation). The developing roller 21 is also rotated in synchronism with that preliminary multi-rotation; and at the same time a developing bias is imposed on the photosensitive drum with the same polarity as the toner, which is opposite to the bias imposed on the drum in a normal copying operation (as shown by an arrow B in FIG. 3). Thus any toner which had been left on the developing roller surface for a long time and had become adversely influenced by the heater of the photosensitive drum is forcibly developed and attached to the non-image area of the photosensitive drum surface so that this toner is removed from the developing roller onto the drum. As the drum continues to rotate the toner is then removed from the drum.

Figure 6:
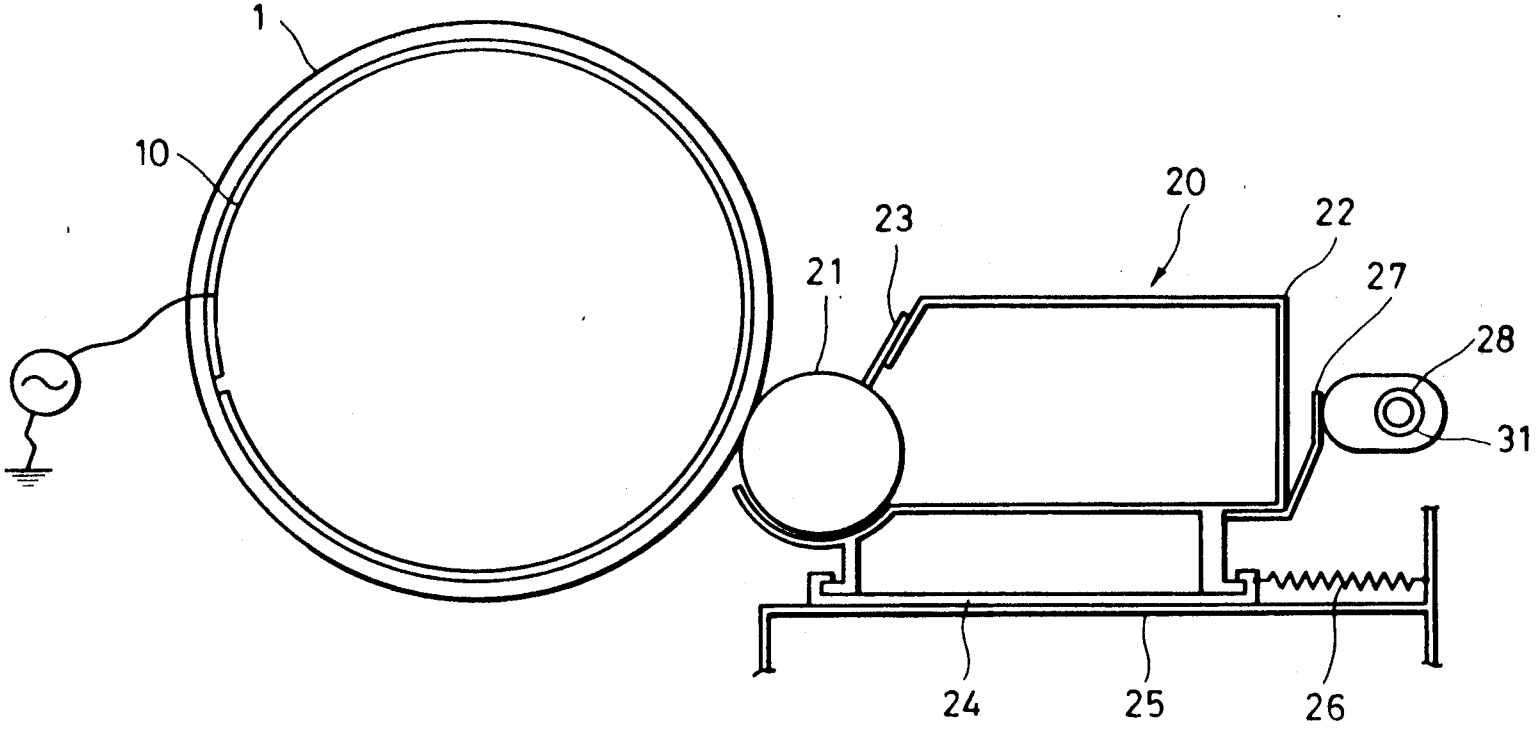
FIG. 6 is a view similar to FIG. 1 and showing another embodiment of the present invention.

The embodiment of FIG. 6 is especially advantageous in a situation where there are a plurality of developing devices around the photosensitive drum as shown in FIG. 2. In such case it is difficult to provide a manual lever 29 to turn off the main switch and simultaneously release the developing device as in FIG. 1. Therefore a solenoid 31 is provided for driving the eccentric cam 28. The solenoid 31 is activated by turning on the main switch instead of moving the manual lever. The solenoid 31 is controlled and driven by a signal at the time of turning off the main switch to release the pressure of the developing device.

As explained above, the electrophotographic apparatus according to the present invention is provided with means which separate the developing roller from the photosensitive drum before suspending its operation for a long time, and/or developing bias is imposed at the time of turning on the main switch for forcibly removing the toner from the developing roller, so that the deterioration of the toner on the developing roller and taint of images coming from the influence of the heater are prevented and decrease of image density is checked at the starting time in the morning.

What is claimed is:

1. In an electrophotographic apparatus having a heater for heating a photosensitive body both when the apparatus is in operation and when the apparatus is not in operation, a main switch arranged to turn the apparatus on and off without turning the heater on or off, and a developing device including a developing roller for applying developer to the photosensitive body, and means for forcibly removing developer from said roller during an interval after said main switch is turned on and before a copying operation.

2. In an electrophotographic apparatus having a heater for heating a photosensitive body both when the apparatus is in operation and when the apparatus is not in operation, a main switch arranged to turn the apparatus on and off without turning the heater on or off, a developing device including a developing roller for applying toner to the photosensitive body and a bias voltage control switch arranged to apply to said developing roller a voltage which forcibly removes toner from the roller during an interval between turning on the main switch and a time when copying with said apparatus becomes possible.

3. In an electrophotographic apparatus having a heater for heating a photosensitive body both when the apparatus is in operation and when the apparatus is not in operation, a main switch arranged to turn the apparatus on and off without turning the heater on or off, and a developing device including a developing roller for applying developer to the photosensitive body, said developing device being arranged to be moved from a first position to a second position in response to the main switch being turned off, wherein, when the developing device is at the first position, the developing roller faces the photosensitive body with a clearance so as to be able to apply the developer to the photosensitive body, and when the developing device is at the second position, the developing roller is retracted from the photosensitive body so as to reduce the heat influence of the heater on the developer carried on the developing roller, wherein said developing device includes means for forcibly removing developer from said roller while said developing device is at said first position and during an interval after said main switch is turned on and before copying with said apparatus becomes possible.

4. The combination of claim 3, further comprising a spring arranged to move the developing device away from said photosensitive body and a releasable holding mechanism arranged to hold said developing device against the force of said spring.

5. The combination of claim 4, wherein said releasable holding mechanism is arranged to be released in response to turning off said main switch.

6. The combination of claim 3 wherein a solenoid is arranged to be operated in response to turning off the main switch to cause the developing device to move from said first position.

7. The combination of claim 5, wherein said developing device is arranged to be moved from said second position to said first position in response to said main switch being turned on.

* * * * *

UNITED STATES PATENT AND TRADEMARK OFFICE

CERTIFICATE OF CORRECTION

PATENT NO. : 5,066,988

DATED : November 19, 1991

INVENTOR(S) : NOBUYUKI MIYAKE

It is certified that error appears in the above-identified patent and that said Letters Patent is hereby corrected as shown below:

On the title page:

IN [57] ABSTRACT

Line 5, "aspect" should read --aspect,--.

In the Drawings:

SHEET 3 OF 6

FIG. 3, "DEVELORING" should read --DEVELOPING--.

COLUMN 6

Line 39, "claim 3" should read --claim 3,--.
Line 43, "claim 5," should read --claim 3,--.

Signed and Sealed this

Eighth Day of June, 1993

*Attest:*

Michael K. Kirk

MICHAEL K. KIRK

*Attesting Officer*

*Acting Commissioner of Patents and Trademarks*